US011262680B2

(12) United States Patent
Fukushima et al.

(10) Patent No.: US 11,262,680 B2
(45) Date of Patent: Mar. 1, 2022

(54) HEAT FIXING DEVICE, ELECTROPHOTOGRAPHIC IMAGE FORMING APPARATUS, AND LAMINATED STRUCTURAL BODY

(71) Applicant: CANON KABUSHIKI KAISHA, Tokyo (JP)

(72) Inventors: Hirotaka Fukushima, Tochigi (JP); Junzo Kobayashi, Tochigi (JP); Toshinori Nakayama, Chiba (JP); Shigeru Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/226,292

(22) Filed: Apr. 9, 2021

(65) Prior Publication Data

US 2021/0325806 A1 Oct. 21, 2021

(30) Foreign Application Priority Data

Apr. 21, 2020 (JP) ..... JP2020-075675

(51) Int. Cl.
*G03G 15/20* (2006.01)
*G03G 13/20* (2006.01)

(52) U.S. Cl.
CPC ..... *G03G 15/2057* (2013.01); *G03G 15/2064* (2013.01); *G03G 2215/2032* (2013.01)

(58) Field of Classification Search
CPC ..... G03G 15/2057; G03G 15/2064; G03G 2215/2032
See application file for complete search history.

(56) References Cited

U.S. PATENT DOCUMENTS 5,705,272 A 1/1998 Taniguchi
5,786,570 A * 7/1998 Miya ..... H05B 3/0095 219/469
6,384,378 B2 5/2002 Natsuhara et al.
9,274,470 B2 3/2016 Nakayama
10,466,631 B1 11/2019 Owaki et al.
(Continued)

FOREIGN PATENT DOCUMENTS

EP 3451065 A1 * 3/2019 ..... C23C 16/325
JP 7-295409 A 11/1995
JP 11-16667 A 1/1999
(Continued)

OTHER PUBLICATIONS

Fukushima et al., U.S. Appl. No. 17/336,592, filed Jun. 2, 2021.
Extended European Search Report in European Application No. 21168827.0 (dated Aug. 2021).

*Primary Examiner* — Clayton E. LaBalle
*Assistant Examiner* — Michael A Harrison
(74) *Attorney, Agent, or Firm* — Venable LLP

(57) ABSTRACT

The fixing device having a long durability life includes a first member, a heater, and a second member, the heater including a base material, an intermediate layer on the base material, and a surface layer on the intermediate layer, which includes a diamond-like carbon film, the base material containing at least one compound selected from the group consisting of aluminum nitride, aluminum oxide, and silicon nitride, and the intermediate layer has a ratio of [(Si)+(C)]/A of 0.8 or more, and a ratio of (Si)/(C) of more than 1.

16 Claims, 11 Drawing Sheets

(56) References Cited

U.S. PATENT DOCUMENTS

| | | | |
|---|---|---|---|
| 2001/0054609 | A1 | 12/2001 | Natsuhara et al. |
| 2015/0016853 | A1 | 1/2015 | Nakayama |

FOREIGN PATENT DOCUMENTS

| | | | | |
|---|---|---|---|---|
| JP | 2002-031976 | A | | 1/2002 |
| JP | 2015-034980 | A | | 2/2015 |
| JP | 2017219662 | A | * | 12/2017 |

* cited by examiner

HEAT FIXING DEVICE, ELECTROPHOTOGRAPHIC IMAGE FORMING APPARATUS, AND LAMINATED STRUCTURAL BODY

BACKGROUND

The present disclosure is directed to a heat fixing device, an electrophotographic image forming apparatus, and a laminated structural body.

DESCRIPTION OF THE RELATED ART

Diamond-like carbon (DLC) is widely used as a surface coating of a sliding member because of its abrasion resistance characteristics. The DLC is used also in a sliding member in an electrophotographic image forming apparatus, such as a copying machine or a printer.

In Japanese Patent Application Laid-Open No. 2015-34980, there is a disclosure of a fixing device including a rotatable first member to be heated by a heat source, a rotatable second member configured to form a nip portion that allows a recording material to be sandwiched between the first member and the second member, and a pressure member which is arranged in the first member, has a contact surface with respect to an inner surface of the first member, and is configured to pressurize the first member against the second member. The pressure member has a surface layer forming a contact surface with respect to the inner surface of the first member, which is formed of a particular diamond-like carbon film (hereinafter sometimes referred to as "DLC film").

According to the investigations made by the inventors, in the case where irregularities of a surface of a base material for forming the pressure member arranged so as to be in contact with an inner peripheral surface of the first member on a side opposed to the DLC film are large, when the pressure member is used as a heating member, the thermal contact between an inner peripheral surface of a fixing belt and a surface layer of a heater may be deteriorated to decrease the thermal conductivity of heat of the heater to the first member.

Meanwhile, when the surface of the base material on a side facing the DLC film is smoothened, the contact area between the DLC film and the base material is reduced, and hence the adhesiveness of the DLC film to the base material is decreased. As a result, during the use of the fixing device, the DLC film peels off from the base material, and the slidability between the first member and the pressure member may be decreased. The decrease in slidability between the first member and the pressure member causes the occurrence of abnormal noise or poor fixing. In view of the foregoing, the inventors have recognized that it is required to develop a technology enabling improvement of the adhesiveness of the DLC film to the base material without depending on the roughness of a DLC film formation surface of the base material.

SUMMARY

One aspect of the present disclosure is directed to providing a heat fixing device, which is excellent in heat transferability to a first member and can exhibit stable heat fixing performance over a long period of time. In addition, another aspect of the present disclosure is directed to providing an electrophotographic image forming apparatus capable of stably forming a high-quality electrophotographic image. Further, another aspect of the present disclosure is directed to providing a laminated structural body excellent in adhesiveness of a DLC film regardless of the smoothness of a base material serving as an adherend surface.

According to one aspect of the present disclosure, there is provided a heat fixing device comprising: a first member which is rotatable; a heater configured to heat the first member; and a second member which is rotatable, and is configured to form a nip portion that allows a recording material to be sandwiched between the first member and the second member, wherein the heater includes a base material, an intermediate layer on the base material, and a surface layer on the intermediate layer, the surface layer constituting a surface configured to slide on an inner peripheral surface of the first member, the base material contains at least one compound selected from the group consisting of aluminum nitride, aluminum oxide, and silicon nitride, the surface layer includes a diamond-like carbon film, and the intermediate layer contains silicon carbide, and when defining a number of silicon atom in the intermediate layer as (Si), a number of carbon atom in the intermediate layer as (C), and a total number of all elements excluding hydrogen atom in the intermediate layer as (A), a ratio of [(Si)+(C)]/A is 0.8 or more, and a ratio of (Si)/(C) is more than 1.

In addition, according to another aspect of the present disclosure, there is provided an electrophotographic image forming apparatus including a heat fixing device configured to heat a toner image on a recording material, to thereby fix the toner image onto the recording material, wherein the heat fixing device is the above-mentioned heat fixing device.

In addition, according to another aspect of the present disclosure, there is provided a laminated structural body including a base material, an intermediate layer, and a diamond-like carbon film in the stated order, wherein the base material contains at least one compound selected from the group consisting of aluminum nitride, aluminum oxide, and silicon nitride, wherein the intermediate layer contains silicon carbide, and wherein when defining a number of silicon atom in the intermediate layer as (Si), a number of carbon atom in the intermediate layer as (C), and a number of total elements excluding hydrogen atom in the intermediate layer as (A), a ratio of [(Si)+(C)]/A is 0.8 or more, and a ratio of (Si)/(C) is more than 1.

Further features of the present disclosure will become apparent from the following description of exemplary embodiments with reference to the attached drawings.

DESCRIPTION OF THE EMBODIMENTS

Now, exemplary embodiments of the present disclosure are described in detail with reference to schematic drawings. The present disclosure is not limited to the following embodiments, and can be variously applied and implemented within the scope of the technical concept of the present disclosure.

Figure 1:
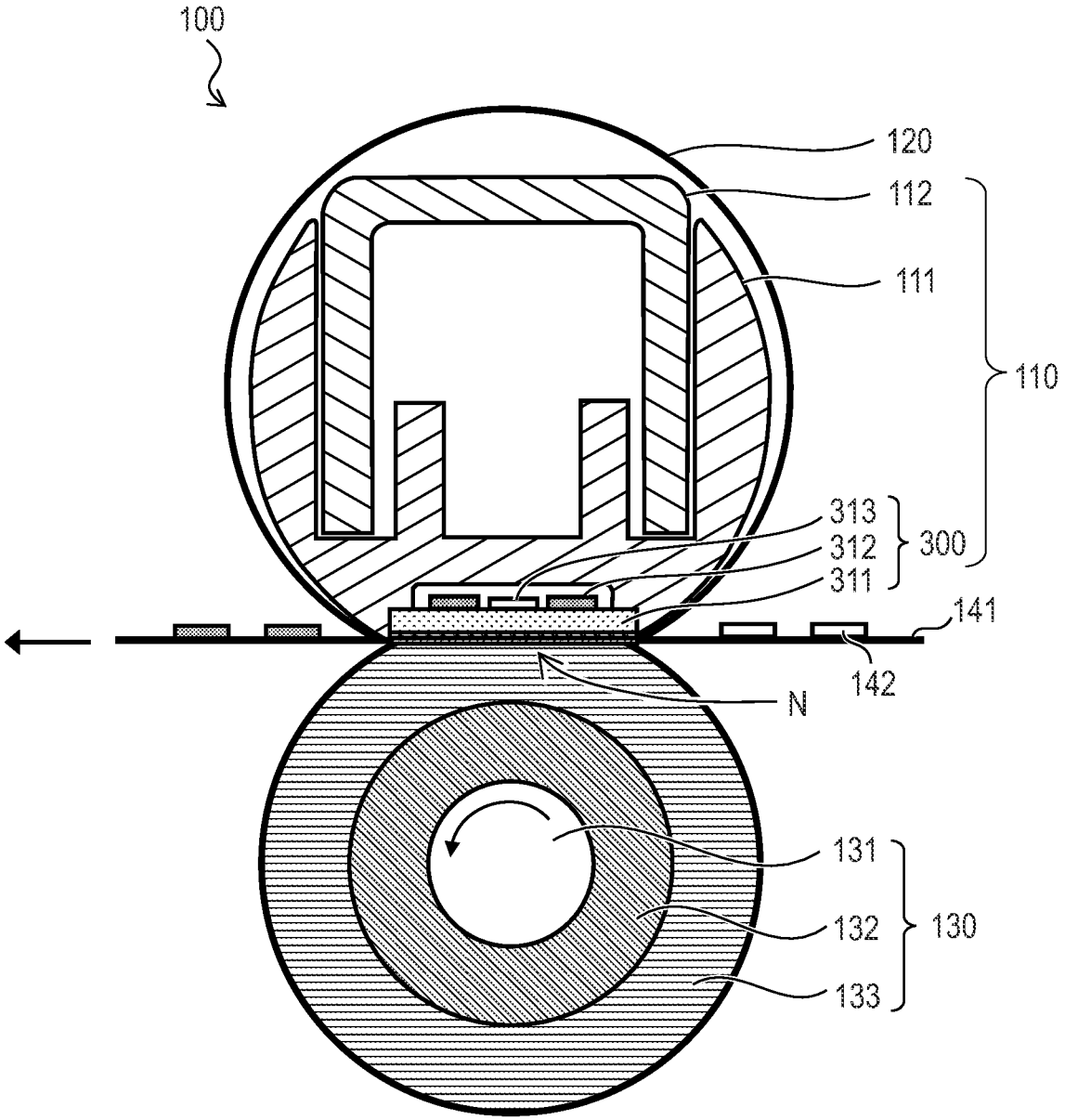
FIG. 1 is a schematic sectional view for illustrating one mode of a heat fixing device of a fixing belt-pressure roller system according to one embodiment of the present disclosure.

FIG. 1 is a schematic sectional view for illustrating an example of a heat fixing device of a fixing belt-pressure roller system using a heater having a laminated structural body according to one embodiment of the present disclosure. The heat fixing device of FIG. 1 includes a first member which is rotationally movable, a second member which is rotationally movable, and a heater configured to heat the first member.

A fixing belt 120 serving as the first member has a sleeve shape and is rotatable. In addition, a pressure roller 130 serving as the second member is configured to form a nip portion N that allows a recording material 141 to be sandwiched between the fixing belt 120 and the pressure roller 130, and the roller is rotatable. In addition, a heater 300, which serves as a heating member and also functions as a pressure member, is arranged in the fixing belt 120, and is brought into contact with an inner peripheral surface of the fixing belt 120 and pressurizes the fixing belt. When the fixing belt 120 rotates, the inner peripheral surface of the fixing belt 120 and a surface layer of the heater 300 form surfaces that slide on each other.

The fixing belt 120 is formed of a sleeve-shaped stainless-steel base material, a silicone rubber layer covering an outer peripheral surface of the stainless-steel base material, and a fluororesin layer covering the top of the silicone rubber layer. An example of the fluororesin is a copolymer of tetrafluoroethylene (hereinafter referred to as "TFE") and a perfluoroalkyl vinyl ether (hereinafter referred to as "PAVE") (hereinafter also referred to as "PFA"). Examples of the PAVE include perfluoromethyl vinyl ether ($CF_2{=}CF{-}O{-}CF_3$), perfluoroethyl vinyl ether ($CF_2{=}CF{-}O{-}CF_2CF_3$), and perfluoropropyl vinyl ether ($CF_2{=}CF{-}O{-}CF_2CF_2CF_3$). A specific example of the fluororesin for forming the fluororesin layer is hereinafter PFA in the same manner.

The fixing belt 120 may have a resin film for forming the inner peripheral surface. It is preferred that the resin film for forming the inner peripheral surface contain polyimide. The size of the fixing belt 120 is not particularly limited, but the inner diameter thereof is, for example, about 55 mm. When the inner diameter of the fixing belt 120 is about 55 mm, the thicknesses of the stainless-steel base material, the silicone rubber layer, the fluororesin layer, and the polyimide film are, for example, 600 μm, 300 μm, 20 μm, and from 1 μm to 20 μm, respectively.

The pressure roller 130 is formed of a stainless-steel metal core 131, a silicone layer 132 covering the outer peripheral surface thereof, and a fluororesin layer 133. The size of the pressure roller 130 is not particularly limited, but the diameter thereof is, for example, about 30 mm. When the diameter of the pressure roller 130 is about 30 mm, the thicknesses of the silicone layer 132 and the fluororesin layer 133 are, for example, 3 mm and 40 μm, respectively.

Figure 3:
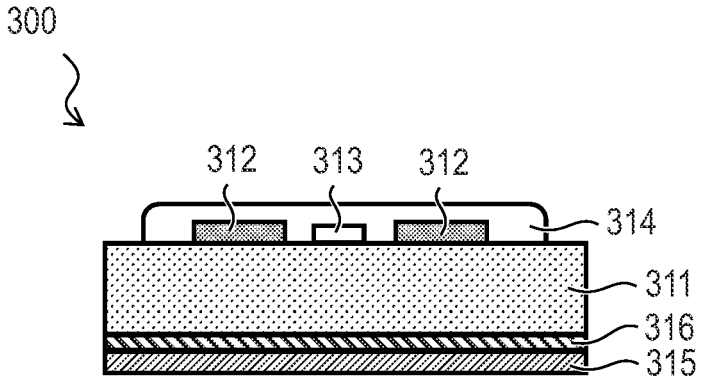
FIG. 3 is a schematic sectional view for illustrating an example of a heater using a laminated structural body according to one embodiment of the present disclosure.

The heater 300 includes a laminated structural body having a schematic sectional structure illustrated in FIG. 3. The laminated structural body includes a base material 311, an intermediate layer 316, and a surface layer 315 including a diamond-like carbon film (DLC film). The base material 311 has a flat strip shape having a direction (direction perpendicular to the drawing sheet) orthogonal to the conveyance direction (arrow direction in FIG. 1) of the recording material 141 as a longitudinal direction.

The surface layer 315 of the heater 300 forms a surface configured to slide on the inner peripheral surface of the fixing belt 120. That is, the surface of the surface layer 315 on an opposite side to a side facing the base material 311 forms a surface configured to slide on the inner peripheral surface of the fixing belt 120. In addition, it is preferred that a lubricant be interposed between the inner peripheral surface of the fixing belt 120 and the surface layer 315 because satisfactory slidability between the inner peripheral surface of the fixing belt and the surface layer can be obtained. Examples of the lubricant include fluorine-based grease containing perfluoropolyether (PFPE) oil and polytetrafluoroethylene (PTFE) as thickeners, and silicone oil.

The heater 300 is held by a heater holder 111, and the heater holder 111 is supported by a reinforcing sheet metal 112 having an inverted U-shaped cross-section. That is, the heater holder 111 to which the heater 300 is fixed is supported by the reinforcing sheet metal 112. The heater holder 111 may be made of, for example, a liquid crystal polymer resin having high heat resistance. Hereinafter, the heater 300, the heater holder 111, and the reinforcing sheet metal 112 are sometimes referred to as "heater unit 110".

Both end portions of the metal core 131 of the pressure roller 130 are rotatably bearing-supported by a device frame (not shown). The pressure roller 130 is driven to rotate at a predetermined speed in the arrow direction in FIG. 1 by a motor (not shown) under a state of being pressurized to an outer peripheral surface of the fixing belt 120.

Both end portions of the reinforcing sheet metal 112 of the heater unit 110 are fixed to the device frame (not shown). The fixing belt 120 is externally fitted to the heater unit 110, and the heater unit 110 is in a state of being pressurized to the inner peripheral surface of the fixing belt 120.

Therefore, the fixing belt 120 rotates through intermediation of the recording material 141 that is conveyed in accordance with the rotation of the pressure roller 130, and the nip portion N that allows the recording material 141 to be sandwiched is formed by the pressure roller 130, the fixing belt 120, and the heater 300. In this case, through energization of resistance heating elements 312 of the heater 300 that slide on the inner peripheral surface of the fixing belt 120, the fixing belt 120 is heated on the sliding surface with the heater 300 and adjusted to a predetermined temperature.

The recording material 141 sandwiched by the nip portion N is conveyed in the arrow direction in FIG. 1 by the rotation of the pressure roller 130 and the fixing belt 120. In addition, in this case, an unfixed toner 142 on the recording material 141 is heated by the heated fixing belt 120 serving as a heat source, and hence is fixed onto the recording material 141.

Figure 11:
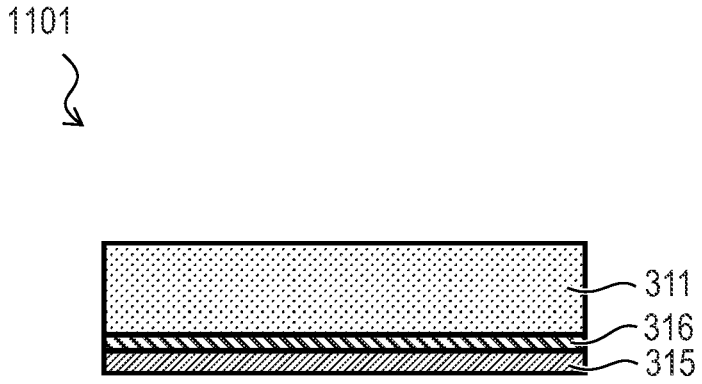
FIG. 11 is a schematic sectional view of a laminated structural body according to another aspect of the present disclosure.

The heat fixing device of a fixing belt-pressure roller system is not limited to the form illustrated in FIG. 1. In the form illustrated in FIG. 1, the heater 300 serving as a heating member forms a part of the pressure member configured to press the fixing belt 120 against the pressure roller 130, but the pressure member and the heating member may be separate members. At this time, the heater 300 is brought into contact with the inner peripheral surface of the fixing belt 120 at a position different from the position illustrated in FIG. 1 to heat the fixing belt 120. In this case, a laminated structural body 1101 according to another aspect of the present disclosure as illustrated in FIG. 11, which includes the base material 311, the intermediate layer 316, and the surface layer 315 including the diamond-like carbon film in the stated order, may be used as the pressure member.

Figure 2:
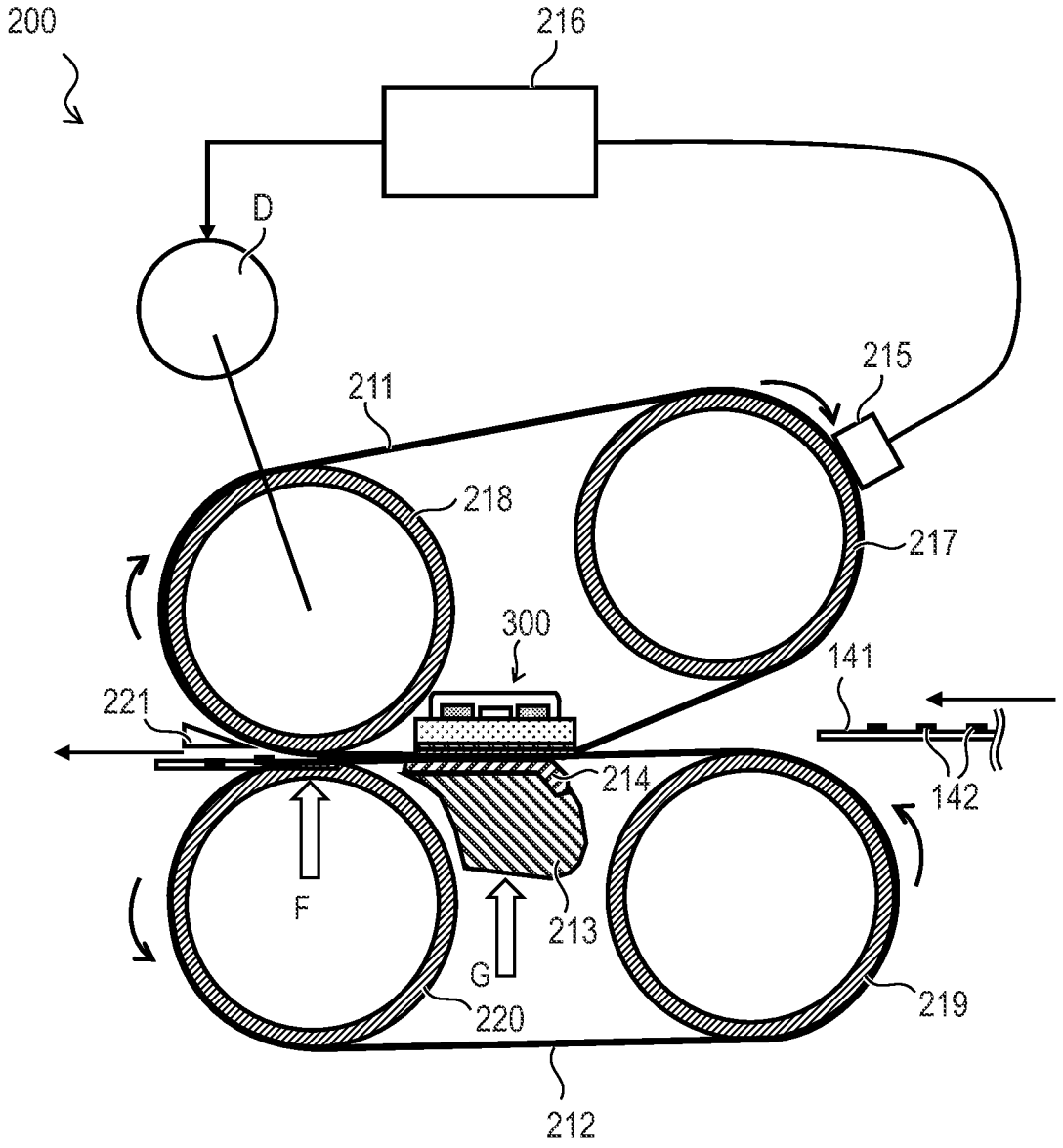
FIG. 2 is a schematic sectional view for illustrating one mode of a heat fixing device of a fixing belt-pressure belt system according to one embodiment of the present disclosure.

In addition, FIG. 2 is a schematic sectional view for illustrating an example of a heat fixing device 200 of a fixing belt-pressure belt system as another embodiment of the heat fixing device of the present disclosure. The heat fixing device 200 illustrated in FIG. 2 is a so-called heat fixing device of a twin belt system in which a fixing belt 211 serving as a first member which is rotationally movable, and a pressure belt 212 serving as a second member which is rotationally movable, the belts forming a pair, are brought into pressure contact with each other, and the device includes the heater 300 configured to heat the fixing belt 211.

In the heat fixing device 200, the fixing belt 211 serving as the first member and the pressure belt 212 serving as the second member are each tensioned over two rollers. The fixing belt 211 and the pressure belt 212 are each formed of, for example, a flexible base material made of a metal containing nickel as a main component, a silicone rubber layer covering an outer peripheral surface thereof, and a fluororesin layer covering the top of the silicone rubber layer. In addition, the fixing belt 211 may have a resin film for forming an inner peripheral surface. It is preferred that the resin film for forming the inner peripheral surface contain polyimide.

The size of each of the fixing belt 211 and the pressure belt 212 is not particularly limited, but the diameter thereof is, for example, 55 mm. When the diameter of the fixing belt 211 is 55 mm, the thicknesses of the flexible base material, the silicone rubber layer, the fluororesin layer, and the polyimide film are, for example, 600 μm, 300 μm, 20 μm and from 1 μm to 20 μm, respectively.

The heating member of the fixing belt 211 is the heater 300 formed of the laminated structural body according to the present disclosure. As illustrated in FIG. 2, the heater 300 is arranged in the fixing belt 211, and is brought into contact with the inner peripheral surface of the fixing belt 211 and heats the fixing belt.

The surface temperature of the fixing belt 211 is detected by a temperature detecting element 215, such as a thermistor, and a signal regarding the temperature of the fixing belt 211 detected by the temperature detecting element 215 is sent to a control circuit unit 216. The control circuit unit 216 is configured to control the electric power supplied to the resistance heating elements 312 so that the temperature information received from the temperature detecting element 215 is maintained at a predetermined fixing temperature, to thereby regulate the temperature of the fixing belt 211 to a predetermined fixing temperature.

The fixing belt 211 is tensioned by a roller 217 serving as a belt rotating member and a heating side roller 218. The roller 217 and the heating side roller 218 are each rotatably bearing-supported between left and right side plates (not shown) of the device.

The roller 217 is, for example, a hollow roller made of iron having an outer diameter of 20 mm, an inner diameter of 18 mm, and a thickness of 1 mm, and functions as a tension roller configured to impart tension to the fixing belt 211. The heating side roller 218 is, for example, a high-slidability elastic roller in which a silicone rubber layer serving as an elastic layer is arranged on a metal core made of an iron alloy having an outer diameter of 20 mm and a diameter of 18 mm.

The heating side roller 218 receives a driving force from a driving source (motor) D serving as a driving roller through a driving gear train (not shown) and is driven to rotate at a predetermined speed in the clockwise direction indicated by the arrow. When the elastic layer is arranged in the heating side roller 218 as described above, the driving force input to the heating side roller 218 can be satisfactorily transmitted to the fixing belt 211, and a fixing nip configured to ensure the separability of the recording material 141 from the fixing belt 211 can be formed. When the heating side roller 218 has the elastic layer, thermal conduction to the heating side roller is reduced, and hence there is a shortening effect on a warm-up time.

When the heating side roller 218 is driven to rotate, the fixing belt 211 rotates together with the roller 217 because of the friction between the silicone rubber surface of the heating side roller 218 and the inner surface of the fixing belt 211. The arrangement and size of each of the roller 217 and the heating side roller 218 are selected in accordance with the size of the fixing belt 211. For example, the dimensions of the roller 217 and the heating side roller 218 are selected so that the fixing belt 211 having an inner diameter of 55 mm in a state of not being mounted can be tensioned.

The pressure belt 212 is tensioned by a tension roller 219 serving as a belt rotating member and a pressure side roller 220. The inner diameter of the pressure belt in a state of not being mounted is, for example, 55 mm. The tension roller 219 and the pressure side roller 220 are each rotatably bearing-supported between the left and right side plates (not shown) of the device.

The tension roller 219 includes, for example, a metal core made of an iron alloy having an outer diameter of 20 mm and an inner diameter of 16 mm, and a silicone sponge layer is arranged on the metal core in order to reduce thermal conduction from the pressure belt 212. The pressure side roller 220 is, for example, a low-slidability rigid roller made of an iron alloy having an outer diameter of 20 mm, an inner diameter of 16 mm, and a thickness of 2 mm. The dimensions of the tension roller 219 and the pressure side roller 220 are selected similarly in accordance with the dimensions of the pressure belt 212.

Herein, in order to form a nip portion between the fixing belt 211 and the pressure belt 212, the pressure side roller 220 has left and right end sides of a rotation shaft pressurized toward the heating side roller 218 at a predetermined pressure force in the direction of the arrow F by a pressure mechanism (not shown).

In addition, a pressure pad is adopted in order to obtain a wide nip portion without enlarging the device. In the heat fixing device 200 illustrated in FIG. 2, there are adopted the heater 300 serving as a first pressure pad configured to pressurize the fixing belt 211 toward the pressure belt 212, and a pressure pad 213 serving as a second pressure pad configured to pressurize the pressure belt 212 toward the fixing belt 211. The heater 300 and the pressure pad 213 are each supported between the left and right side plates (not shown) of the device. The pressure pad 213 is pressurized toward the heater 300 at a predetermined pressure force in the direction of the arrow G by a pressure mechanism (not shown).

The surface layer 315 of the heater 300 serving as the first pressure pad forms a surface configured to slide on the inner peripheral surface of the fixing belt 211. It is preferred that a lubricant be interposed between the inner peripheral surface of the fixing belt 211 and the surface layer 315 because satisfactory slidability can be obtained. Examples of the lubricant include fluorine-based grease containing perfluoropolyether (PFPE) oil and polytetrafluoroethylene (PTFE) as thickeners, and silicone oil. In addition, the pressure pad 213 serving as the second pressure pad has a sliding sheet 214 that is brought into contact with a pad substrate and the belt. When the pressure pad 213 is brought into direct contact with the inner peripheral surface of the pressure belt 212, a portion to be rubbed may be significantly scraped. In this case, the sliding sheet 214 may be interposed between the pressure belt 212 and the pressure pad 213. Through use of the sliding sheet 214, the pressure pad 213 is prevented from being scraped, and the sliding resistance between the belt and the pad can be reduced, with the result that satisfactory belt running performance and more excellent durability are obtained. The fixing belt 211 is provided with a non-contact charge eliminating brush (not shown), and the pressure belt is provided with a contact charge eliminating brush (not shown).

The control circuit unit 216 is configured to drive the motor D at least during image formation. Thus, the heating side roller 218 is driven to rotate, and the fixing belt 211 is driven to rotate in the same direction as that of the heating side roller 218. The pressure belt 212 rotates in accordance with the fixing belt 211. Herein, slipping of the belt can be prevented by configuring the most downstream portion of the nip so that the recording material 141 is conveyed under a state in which the fixing belt 211 and the pressure belt 212 are sandwiched by a roller pair of the heating side roller 218 and the pressure side roller 220. The most downstream portion of the nip is a portion in which the pressure distribution in the nip (recording material conveyance direction) is maximized.

Under a state in which the fixing belt 211 is raised to and maintained at a predetermined fixing temperature (sometimes referred to as "temperature control"), the recording material 141 having the unfixed toner 142 thereon is conveyed to the nip portion between the fixing belt 211 and the pressure belt 212. The recording material 141 is introduced with the surface carrying the unfixed toner 142 facing the fixing belt 211 side. Then, the recording material 141 is sandwiched and conveyed while the unfixed toner 142 thereof is in close contact with the outer peripheral surface of the fixing belt 211, with the result that the unfixed toner receives heat and a pressure force from the fixing belt 211 to be fixed onto the surface of the recording material 141. In this case, the heat from a heated substrate of the fixing belt 211 is efficiently transported toward the recording material 141 through the elastic layer having increased thermal conductivity in the thickness direction. After that, the recording material 141 is separated from the fixing belt 211 by a separation member 221 and conveyed.

The heat fixing device of a fixing belt-pressure belt system is not limited to the form illustrated in FIG. 2. For example, in the form illustrated in FIG. 2, the heater 300 serving as the heating member is used also as the first pressure pad serving as the pressure member. That is, in the form illustrated in FIG. 2, the pressure member and the heating member are used as the same member, but the heater 300 and the first pressure pad may be separate members. In this case, the heater 300 is brought into contact with the inner peripheral surface of the fixing belt 211 at a position different from that illustrated in FIG. 2 to heat the fixing belt 211. In this case, in the same manner as in the heat fixing device of a fixing belt-pressure roller system, a laminated structural body including the base material 311, the intermediate layer 316, and the surface layer 315 including the DLC film in the stated order may be used as the first pressure pad. In addition, a pressure pad having a sliding sheet may be used as the first pressure pad. Further, the laminated structural body including the base material 311, the intermediate layer 316, and the surface layer 315 including the DLC film in the stated order may be used as the second pressure pad.

FIG. 3 is a schematic sectional view for illustrating an example of a laminated structural body according to one embodiment of the present disclosure. The laminated structural body includes the base material 311, the intermediate layer 316, and the diamond-like carbon (DLC) film in the stated order, and the DLC film forms the surface layer 315.

When the laminated structural body is used as the heater 300, the heater 300 includes the resistance heating elements 312 and a thermistor that is a temperature sensor 313 on a surface of the base material 311 on an opposite side to a surface on which the intermediate layer 316 is arranged. In addition, the resistance heating elements 312 are insulated and coated with a glass layer 314. A material for the base material 311 is required to be an insulating material because the resistance heating elements 312 are formed thereon. In addition, it is preferred that the material for the base material 311 have a high thermal conductivity so that the heat from the resistance heating elements 312 is easily transferred to the fixing belt 120. For this reason, the base material 311 contains one compound selected from the group consisting of aluminum nitride, aluminum oxide, and silicon nitride. In addition, it is preferred that the base material 311 be made of one compound selected from the group consisting of aluminum nitride, aluminum oxide, and silicon nitride. When the base material 311 is made of aluminum nitride and has a flat strip shape having dimensions of, for example, 400 mmx 8 mm, the aluminum nitride may be oxidized to a depth of hundreds of nanometers from the surface thereof.

When DLC contains hydrogen, the hardness thereof is decreased. Therefore, it is preferred that the DLC film for forming the surface layer 315 be a DLC film that does not substantially contain hydrogen atoms excluding unavoidable components in production and an adsorption gas on the film surface. That is, it is more desired that a measurement value be equal to or less than a measurement error when analysis is performed by an analysis device of elastic recoil detection analysis (ERDA) using a heavy ion beam or the like. Therefore, it is preferred that when defining a number of hydrogen atom in the diamond-like carbon film as (H), and a number of carbon atom in the diamond-like carbon film as (C'), a ratio of (H)/[(H)+(C')] is 0.00 or more and 0.02 or less.

The intermediate layer 316 containing silicon carbide is formed between the surface layer 315 and the base material 311. When defining a number of silicon atom in the intermediate layer as (Si), a number of carbon atom in the intermediate layer as (C), and a total number of all elements excluding hydrogen atom in the intermediate layer as (A), a ratio of [(Si)+(C)]/A is 0.8 or more. In addition, a ratio of (Si)/(C) is more than 1. When those conditions are satisfied, the intermediate layer 316 exhibits strong adhesiveness to the base material 311 and the DLC film, and functions as an excellent adhesion layer of the base material 311 and the surface layer 315 including the DLC film.

In the case where the intermediate layer 316 is analyzed by X-ray photoelectron spectroscopy (XPS) through use of AlKα as a light source, when a peak top of binding energy of a 2p orbital of the silicon atom in the intermediate layer is present at a position in the range of from more than 99.0 eV at which the peak top indicating the binding energy of silicon appears to less than 100.4 eV at which the peak top indicating the binding energy of silicon carbide appears, the foregoing shows that the intermediate layer 316 is a silicon simple substance or a composite of silicon containing silicon-rich silicon carbide and silicon carbide. Such intermediate layer 316 is preferred because the intermediate layer exhibits an enhancing effect on the adhesiveness to the base material 311 and the surface layer 315.

Further, in the case where the intermediate layer 316 is analyzed by X-ray photoelectron spectroscopy (XPS), when the ratio of (Si)/(C) in the intermediate layer is 2.0 or more, the foregoing shows that the intermediate layer 316 is a silicon simple substance or a composite of silicon containing silicon-rich silicon carbide and silicon carbide. Such intermediate layer 316 is preferred because the intermediate layer exhibits an enhancing effect on the adhesiveness to the base material 311 and the surface layer 315. In addition, when the ratio of (Si)/(C) is 2.6 or less, the film hardness of the intermediate layer 316 is lowered, and as a result, the deterioration of the adhesiveness of the DLC film can be more reliably prevented. Therefore, the ratio of (Si)/(C) of the intermediate layer is more preferably 2.0 or more and 2.6 or less.

In the laminated structural body having the above-mentioned structure, even when the surface of the base material on a side on which the DLC film is formed is a smooth surface having an arithmetic average roughness of, for example, from 0.13 μm to 0.35 μm, the peeling of the surface layer 315 can be prevented. As a result, the life of the heat fixing device can be increased. That is, the laminated structural body according to the present disclosure contributes to further improvement of durability of the heat fixing device.

Figure 4:
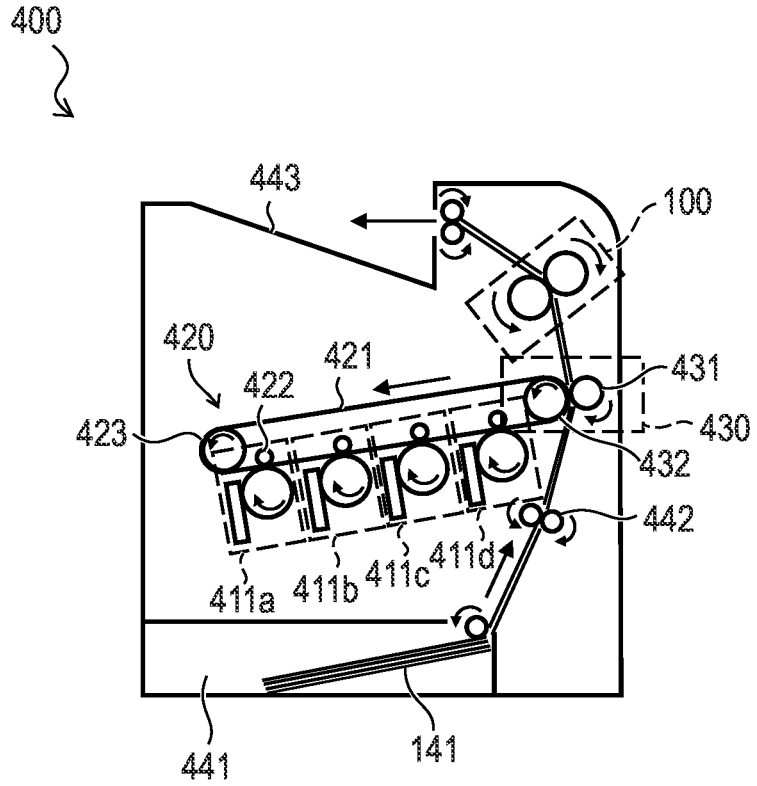
FIG. 4 is a schematic sectional view for illustrating an example of an electrophotographic image forming apparatus according to one embodiment of the present disclosure.

FIG. 4 is a schematic sectional view of an electrophotographic full-color printer of a laser exposure system, which is an example of an electrophotographic image forming apparatus using the heat fixing device 100 of a fixing belt-pressure roller system according to one embodiment of the present disclosure. The printer 400 includes toner image forming devices 411*a* to 411*d*, a primary transfer device 420, a secondary transfer device 430, the heat fixing device 100, a sheet feeding portion 441, feed rollers 442, a delivery tray 443, an external host device (not shown), and a laser light source for exposure (not shown). A full-color image can be formed and output onto the recording material 141 in accordance with input image information from the external host device (not shown).

A toner image is formed on the surface of each of drum-shaped electrophotographic photosensitive members built in the toner image forming devices 411*a* to 411*d* for respective colors of yellow, magenta, cyan, and black by a laser exposure system using the laser light source for exposure (not shown) based on a color separation image signal input from the external host device (not shown). An electrophotographic image forming process by the laser exposure system is known, and hence the description thereof is omitted.

The primary transfer device 420 includes an endless-shaped (endless) flexible primary transfer belt 421, primary transfer rollers 422, and a tension roller 423.

The four-color toner images formed by the respective toner image forming devices 411*a* to 411*d* are superimposed and transferred onto the primary transfer belt 421 that is tensioned and rotated by the tension roller 423 and a secondary transfer opposing roller 432 by the respective primary transfer rollers 422. Thus, an unfixed full-color toner image is formed on the primary transfer belt 421.

Meanwhile, at a predetermined sheet feeding timing, the recording material (paper) 141 is conveyed from the sheet feeding portion 441 to the secondary transfer device 430 including the secondary transfer roller 431 and the secondary transfer opposing roller 432 by the feed rollers 442. Herein, the unfixed full-color toner image on the primary transfer belt 421 is transferred onto the recording material 141, such as paper.

After that, the recording material 141 is conveyed to the heat fixing device 100 and heated. When the recording material 141 is heated, the unfixed full-color toner image on the recording material 141 is melted to be color-mixed and fixed onto the recording material 141 as a fixed image. After that, the recording material (paper) 141 having the toner image fixed thereon is delivered to the delivery tray 443.

The electrophotographic image forming apparatus according to one embodiment of the present disclosure is not limited to the form illustrated in FIG. 4, and also encompasses an electrophotographic image forming apparatus in which the heat fixing device 200 of a fixing belt-pressure belt system is used instead of the heat fixing device 100 of a fixing belt-pressure roller system.

Now, film forming methods of the intermediate layer 316 and the surface layer 315 in the laminated structural body according to one embodiment of the present disclosure are described. However, the film forming methods are not limited thereto.

In addition, the intermediate layer 316 in FIG. 3 may be formed by a physical vapor deposition method, such as a sputtering method or an arc vapor deposition method using a Si or SiC target as a raw material, or a chemical vapor deposition method using a hydrocarbon gas and a silane gas as raw materials. The physical vapor deposition method is more preferred from the viewpoint that the composition ratio of impurities, Si, and C, and the bonding state of silicon atoms and carbon atoms are easily controlled.

Figure 5:
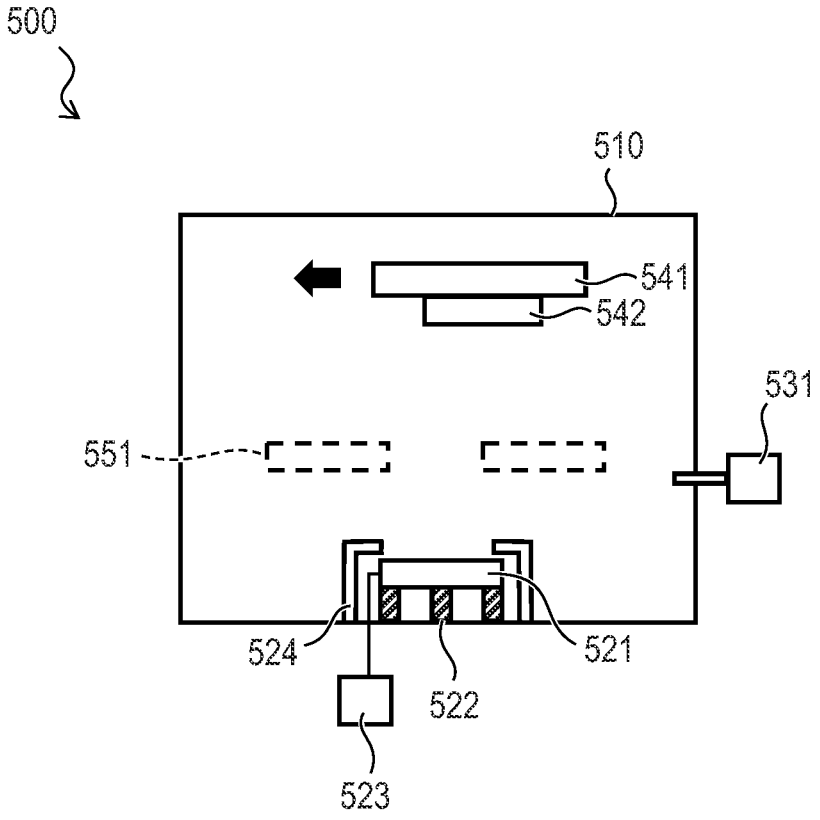
FIG. 5 is a schematic sectional view for illustrating an example of an intermediate layer forming device configured to form an intermediate layer in the laminated structural body according to one embodiment of the present disclosure.

As an example, an intermediate layer forming device 500 using a sputtering method, which is one of the physical vapor deposition methods, is illustrated in FIG. 5. The intermediate layer forming device 500 includes a vacuum chamber 510 in which film formation treatment is performed, a vacuum pump (not shown) configured to vacuumize and evacuate the vacuum chamber 510, a target 521 to be a film material, a power supply 523 configured to apply electric power to the target 521, magnets 522 arranged on a back surface of the target, anode electrodes 524 arranged on the periphery of the target, a gas piping and mass flow controller 531 configured to introduce a process gas into the vacuum chamber 510, a base material holder 541 on which a film formation target base material 542 is installed, a driving mechanism (not shown) configured to move the base material holder 541 during film formation, and a mask 551 configured to control the film thickness distribution of the film formation target base material 542.

The formation of the intermediate layer 316 through use of the intermediate layer forming device 500 is performed, for example, by the method described below. An Ar gas is introduced from the gas piping and mass flow controller 531 into the vacuum chamber 510 exhausted by the vacuum pump, and the degree of vacuum in the vacuum chamber 510 is set to a desired degree of vacuum.

Then, when electric power is applied to the target 521 by the power supply 523, an Ar plasma discharge is formed between the target 521 and the anode electrodes 524. In this case, the Ar plasma density is further increased with magnetic lines produced by the magnets 522.

Material particles are sputtered from the target 521 by ions in the formed Ar plasma. The sputtered material particles reach the film formation target base material 542 installed on the base material holder 541, and the intermediate layer 316 is formed on the film formation target base material 542.

The amount of the particles sputtered from the target 521 that reach the film formation target base material 542 varies depending on the position of the film formation target base material 542. In view of the foregoing, the base material holder 541 on which the film formation target base material 542 is installed is moved in the direction of the arrow in FIG. 5 during film formation so that, in a portion in which the amount of the sputtering particles reaching the film formation target base material 542 is large, the particles are partially shielded with the mask 551 installed between the target 521 and the film formation target base material 542. Thus, the film thickness of the intermediate layer 316 formed on the film formation target base material 542 is uniformly corrected.

When the target used herein has conductivity, a plasma discharge can be formed through use of a DC power supply as the power supply 523 configured to apply electric power to the target. When the target used herein has an insulation property, a plasma discharge can be formed through use of a high-frequency (RF) power supply as the power supply 523 configured to apply electric power to the target.

In addition, the gas to be introduced into the vacuum chamber 510 is not limited to Ar, and a gas, such as Xe or He, may be used instead of Ar or as a mixture with Ar.

A diamond-like carbon (DLC) film may be formed as the surface layer 315 by a physical vapor deposition method, such as an arc vapor deposition method or a sputtering method using graphite as a raw material, or a chemical vapor deposition method using a hydrocarbon gas as a raw material. The physical vapor deposition method using graphite as a raw material is more preferred because the amount of hydrogen in the DLC film can be easily reduced.

Figure 6:
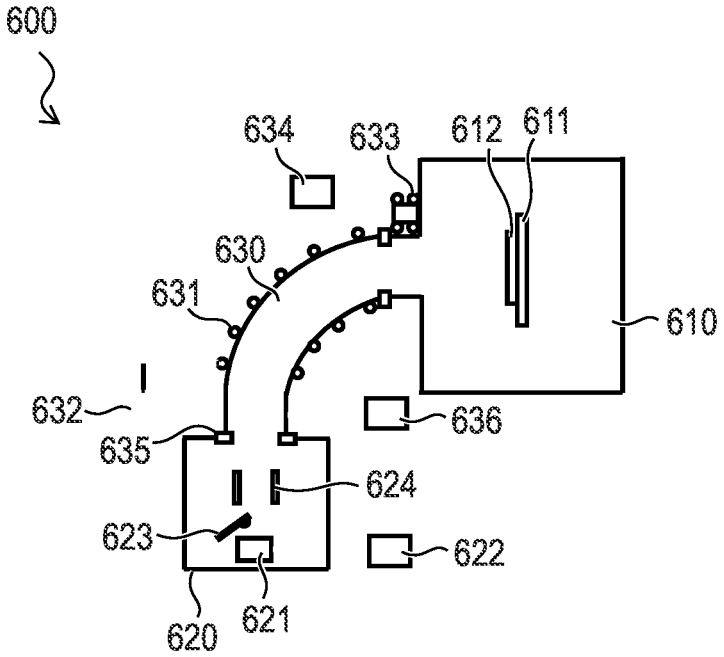
FIG. 6 is a schematic sectional view for illustrating an example of a device configured to form a diamond-like carbon film in the laminated structural body according to one embodiment of the present disclosure.

As an example, a DLC film forming device 600 using an arc vapor deposition method is illustrated in FIG. 6. The DLC film forming device 600 includes a film forming chamber 610 in which film formation treatment is performed, an arc plasma generation chamber 620 in which an arc plasma discharge is generated to evaporate a film material, and a duct filter 630 configured to transport the film material generated in the arc plasma generation chamber 620 to the film forming chamber 610.

The film forming chamber 610 is maintained in a vacuum state by a vacuum pump (not shown). A film formation target base material 612 is arranged in the film forming chamber 610 by a base material holder 611. The base material holder 611 is configured to rotate or move the film formation target base material 612 during film formation as required, thereby being capable of performing film formation suitable for the shape of the film formation target base material 612.

The arc plasma generation chamber 620 is maintained in a vacuum state by a vacuum pump (not shown) in the same manner as in the film forming chamber 610. A graphite target 621 is arranged in the arc plasma generation chamber 620. An arc discharge power supply 622 configured to generate an arc discharge is connected to the graphite target 621. A striker 623 configured to ignite the arc discharge and anodes 624 for the arc discharge are arranged above the graphite target 621.

A duct coil 631 configured to generate a magnetic field for deflecting the film material is arranged on the duct filter 630. A duct coil power supply 632 configured to energize the duct coil 631 is connected to the duct coil 631. In addition, a scanning coil 633 configured to generate a magnetic field for scanning charged particles of the film material is arranged at a distal end of the duct filter 630. A scanning coil power supply 634 is connected to the scanning coil 633. In addition, the duct filter 630 is insulated from the film forming chamber 610 and the arc plasma generation chamber 620 by an insulating member 635. In addition, the duct filter 630 is connected to a duct filter power supply 636 so that its electric potential can be controlled.

An arc plasma can be generated between the graphite target 621 and the anodes 624 by applying electric power from the arc discharge power supply 622 when the striker 623 connected to the ground is brought into contact with the graphite target 621 having electric power applied thereto from the arc discharge power supply 622, or when the striker 623 is separated from the graphite target 621. The film material is evaporated from the graphite target 621 with the arc plasma.

When the graphite target 621 is evaporated with the arc plasma, fine particles of about several micrometers called droplets are generated. Such droplets are not DLC but graphite. Graphite has a disadvantage of reducing the film hardness. Therefore, it is required to adjust the number of the fine particles as required.

The duct filter 630 configured to transport the film material generated in the arc plasma generation chamber 620 to the film forming chamber 610 is curved. The film material evaporated with the arc plasma has become charged particles, and hence is transported to the film forming chamber 610 along the axis of the duct filter 630 with a magnetic field formed in the duct filter 630 by the duct coil 631 and the duct coil power supply 632. In contrast, the droplets are neutral in many cases, and hence travel straight without being deflected with the magnetic field formed in the duct filter 630 to collide with a curved portion of the duct filter 630. Therefore, the amount of the droplets that are transported to the film forming chamber 610 is reduced and adjusted.

The film material is generated in the arc plasma generation chamber 620 and is transported to the film forming chamber 610 through the duct filter 630. After that, the film material collides with the film formation target base material 612 having the intermediate layer 316 formed thereon and is laminated thereon.

In addition, when the electric potential is controlled by the duct filter power supply 636 connected to the duct filter 630, the transport amount of the film material and the amount of the droplets can be adjusted.

The content of hydrogen by ERDA of the surface layer 315 including the formed DLC film is usually about 0.5 atomic %.

In addition, it is more desired that the surface layer 315 and the intermediate layer 316 serving as the sliding layers be formed continuously under a vacuum state. This is because, when the film formation target base material 612 having the intermediate layer 316 formed thereon is exposed to the atmosphere during a time period from the formation of the intermediate layer 316 to the formation of the surface layer 315, the adhesiveness between the intermediate layer 316 and the surface layer 315 may be changed by the oxidation of a part of the outermost surface of the intermediate layer 316 and the adsorption of a gas or moisture in the atmosphere to the outermost surface of the intermediate layer 316. Therefore, it is more preferred to use devices having a configuration in which the chambers of the devices illustrated in FIG. 5 and FIG. 6 are coupled to each other.

According to one mode of the present disclosure, there can be obtained the heat fixing device, which is excellent in heat transferability to the first member and can exhibit stable heat fixing performance over a long period of time. In addition, according to another mode of the present disclosure, there can be obtained the electrophotographic image forming apparatus capable of stably forming a high-quality electrophotographic image. Further, according to another mode of the present disclosure, there can be obtained the laminated structural body excellent in adhesiveness of the DLC film regardless of the smoothness of the base material serving as an adherend surface.

EXAMPLES

Now, the heat fixing device and the like according to one mode of the present disclosure are specifically described by way of Examples and Comparative Examples. The heat fixing device and the like according to the present disclosure are not limited to the configuration embodied in the Examples.

Example 1

As Example 1, a laminated structural body was produced. In the laminated structural body, an intermediate layer and a surface layer were formed in the stated order on one surface of a base material made of aluminum nitride (hereinafter sometimes referred to as "AlN") through use of devices having a configuration in which the chambers of the devices illustrated in FIG. 5 and FIG. 6 were coupled to each other. The surface of the base material was coated with a thin film made of an oxide of aluminum (hereinafter sometimes referred to as "AlO").

First, an intermediate layer was formed on a base material serving as the film formation target base material 542 having an arithmetic average roughness Ra of 0.13 μm through use of a device having the same configuration as that of the intermediate layer forming device 500 illustrated in FIG. 5. As the film forming conditions, a composite target in which silicon and silicon carbide were mixed was used as the target 521, the electric power applied by the power supply 523 was set to 550 W, and the pressure of the vacuum chamber 510 during film formation was set to 0.9 Pa. The presence ratio "silicon:silicon carbide" between silicon and silicon carbide in the composite target was 1.4:1 as a median value.

Subsequently, the surface layer 315 including a DLC film using the graphite target 621 as a raw material was formed on the intermediate layer formed in the foregoing through use of a device having the same configuration as that of the DLC film forming device 600 illustrated in FIG. 6. Thus, the laminated structural body was produced.

In a silicon wafer substrate on which a layer corresponding to an intermediate layer was formed under the same conditions as the film forming conditions of the intermediate layer in the production of Example 1, a step was formed between a portion in which the layer corresponding to the intermediate layer was formed and a portion in which the layer was not formed by masking a part of the substrate. The height of the step was measured through use of a stylus profiler (product name: P-15, manufactured by KLA-Tencor Corporation), and the height was found to be 60 nm. This result was adopted as the film thickness of the intermediate layer in the laminated structural body according to Example 1.

A layer formed under the same conditions as the film forming conditions of the intermediate layer in the production of Example 1 was analyzed by X-ray photoelectron spectroscopy (XPS) using an X-ray photoelectron spectrophotometer (product name: Quantera SXM, manufactured by ULVAC-PHI, Incorporated, light source: AlKα). Only a layer corresponding to the intermediate layer was formed on a silicon wafer substrate, and the outermost surface thereof, and portions, which were etched by 13 nm and 25 nm, respectively, from the outermost surface through use of Ar ions in an XPS vacuum chamber, were analyzed. Elements that were able to be detected by XPS were silicon, carbon, and oxygen that was regarded as an unavoidable impurity mixed during film formation. The content of oxygen in the range of from the portion etched by 13 nm from the outermost surface to the portion etched by 25 nm from the outermost surface, that is, the layer corresponding to the intermediate layer was 4.9 atomic %. In the layer corresponding to the intermediate layer, when defining a number of silicon atom as (Si), a number of carbon atom as (C), and a total number of all elements excluding hydrogen atom as (A), a ratio of [(Si)+(C)]/A that was not able to be detected by XPS was 0.95, and the layer corresponding to the intermediate layer 316 was formed of silicon and carbon.

In addition, a ratio of (Si)/(C) in the layer corresponding to the intermediate layer was 2.02.

In addition, in the film forming method described in this embodiment using the devices having the configuration in which the chambers of the devices illustrated in FIG. 5 and FIG. 6 are coupled to each other, there is no positive hydrogen source into the DLC film, and residual moisture and the like in the chamber serve as a hydrogen source. When defining a number of hydrogen atom in the DLC film diamond-like carbon film as (H) and a number of carbon atom in the DLC film diamond-like carbon film as (C'), a ratio of (H)/[(H)+(C')] was 0.015. Therefore, the amount of hydrogen contained in the DLC film according to this Example was equal to or less than that of oxygen that was an unavoidable component.

Figure 7:
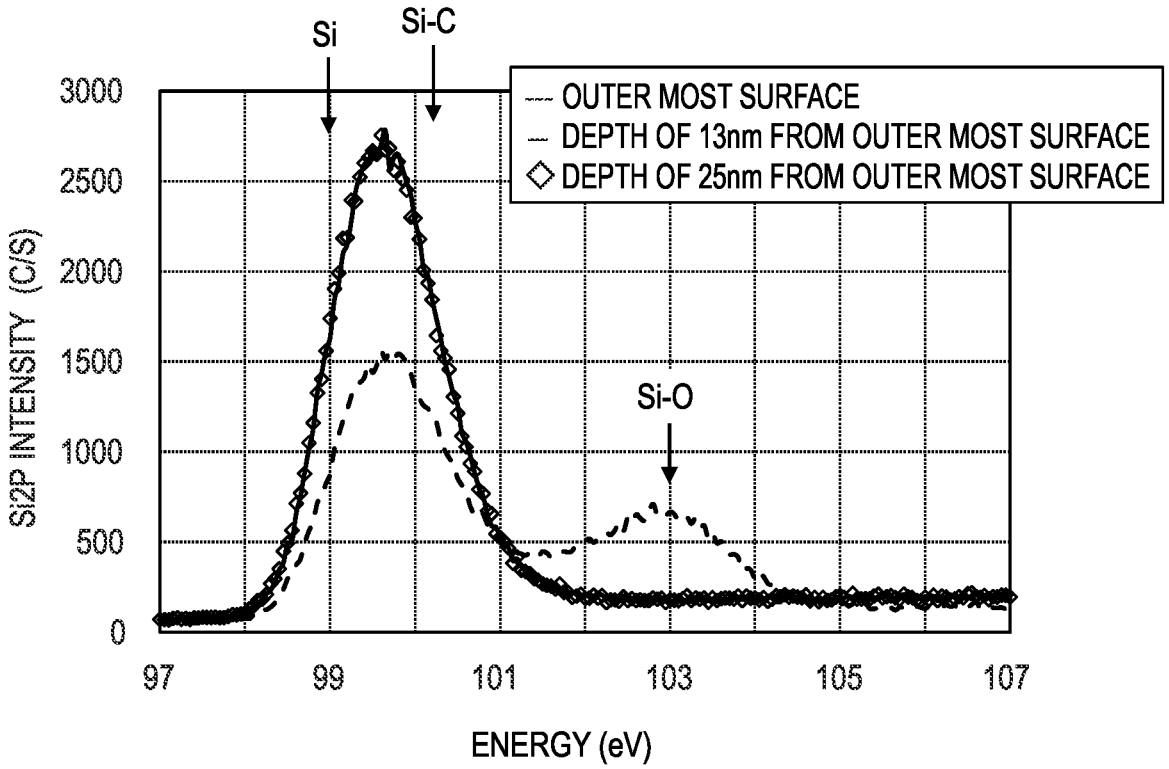
FIG. 7 is a graph for showing the bonding state of silicon atoms obtained as a result of the analysis of an intermediate layer formed in Example 1 by X-ray photoelectron spectroscopy (XPS).

The bonding state of the silicon atoms obtained by XPS is shown in FIG. 7. A peak top of binding energy of a 2p orbital of the silicon atom was found at an intermediate position between 99.0 eV at which the peak top indicating the binding energy of silicon appeared and 100.4 eV at which the peak top indicating the binding energy of silicon carbide appeared. A peak indicating the binding energy of silicon oxide was found on the outermost surface, and it was conceived that the forgoing resulted from the oxidation caused by exposure to the atmosphere and the adsorption of moisture in the atmosphere during a time period from the completion of the film formation to the analysis.

Figure 8:
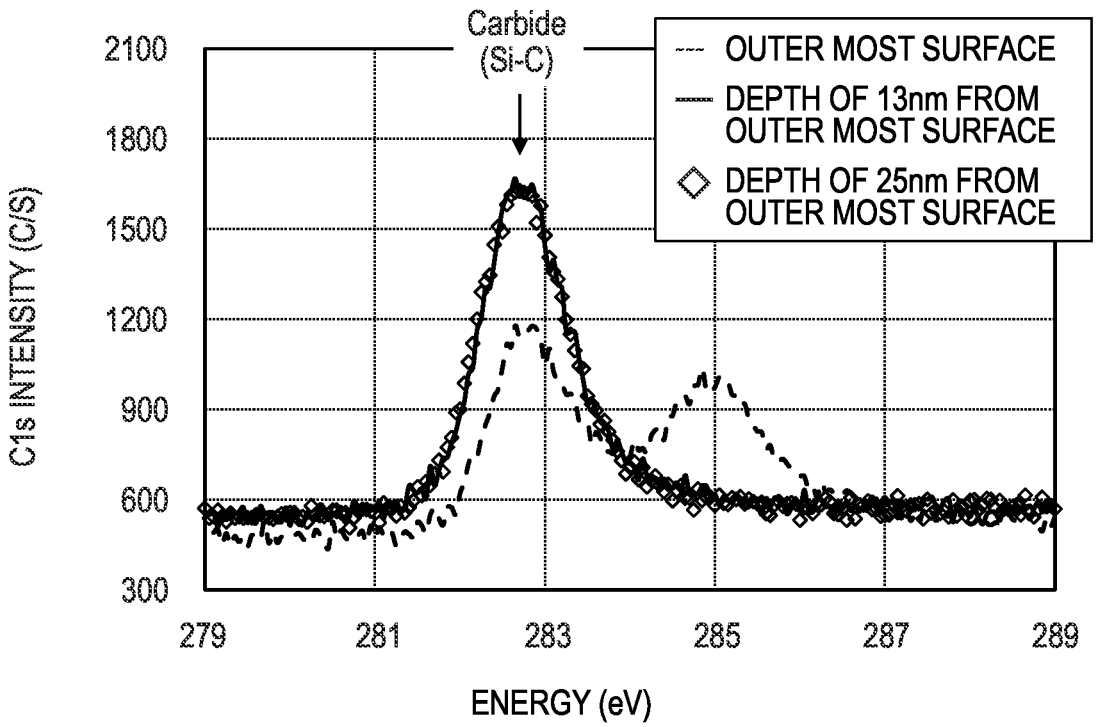
FIG. 8 is a graph for showing the bonding state of carbon atoms obtained as a result of the analysis of the intermediate layer formed in Example 1 by XPS.

The bonding state of carbon atoms obtained by XPS is shown in FIG. 8. The peak top of binding energy of a is orbital of the carbon atom was found at a position at which the peak top indicating the binding energy of silicon carbide appeared. Therefore, it was found from the XPS results that the intermediate layer was a composite of silicon and silicon carbide.

In addition, the film thickness of the surface layer was also determined with a stylus profiler in the same manner as that of the film thickness of the intermediate layer 316, and the film thickness was 500 μm.

Example 2

A laminated structural body was produced in the same manner as in Example 1 except that the film thickness of the intermediate layer was set to 20 nm. Analysis was performed by XPS in the same manner as in the method described in Example 1, and silicon and carbon, and oxygen that was regarded as an unavoidable impurity mixed during film formation were detected as elements. The content of oxygen in the layer corresponding to the intermediate layer 316 was 2.8 atomic %, and when defining a number of silicon atom in the intermediate layer as (Si), a number of carbon atom in the intermediate layer as (C), and a total number of all elements excluding hydrogen atom in the intermediate layer as (A), a ratio of [(Si)+(C)]/A that was not able to be detected by XPS was 0.95. The layer corresponding to the intermediate layer 316 was formed of silicon and carbon. In addition, a ratio of (Si)/(C) was 2.55.

Example 3

A laminated structural body was produced in the same manner as in Example 2 except that the film thickness of the surface layer was set to 650 nm. Analysis was performed by XPS in the same manner as in the method described in Example 1, and the content of oxygen and the ratio of (Si)/(C) in the layer corresponding to the intermediate layer 316 were the same as those in Example 2.

Example 4

A laminated structural body was produced in the same manner as in Example 1 except that a base material whose surface had an arithmetic average roughness Ra of 0.35 μm was used.

Example 5

A laminated structural body was produced in the same manner as in Example 1 except that a ratio of (Si)/(C) in the layer corresponding to the intermediate layer 316 was 1.55.

Comparative Example 1

A laminated structural body was produced in the same manner as in Example 1 except that the intermediate layer was not formed.

Comparative Example 2

An intermediate layer formed of Ti having a film thickness of 60 nm was formed through use of a titanium target as the target. A laminated structural body was produced in the same manner as in Example 1 except the foregoing.

Comparative Example 3

Figure 9:
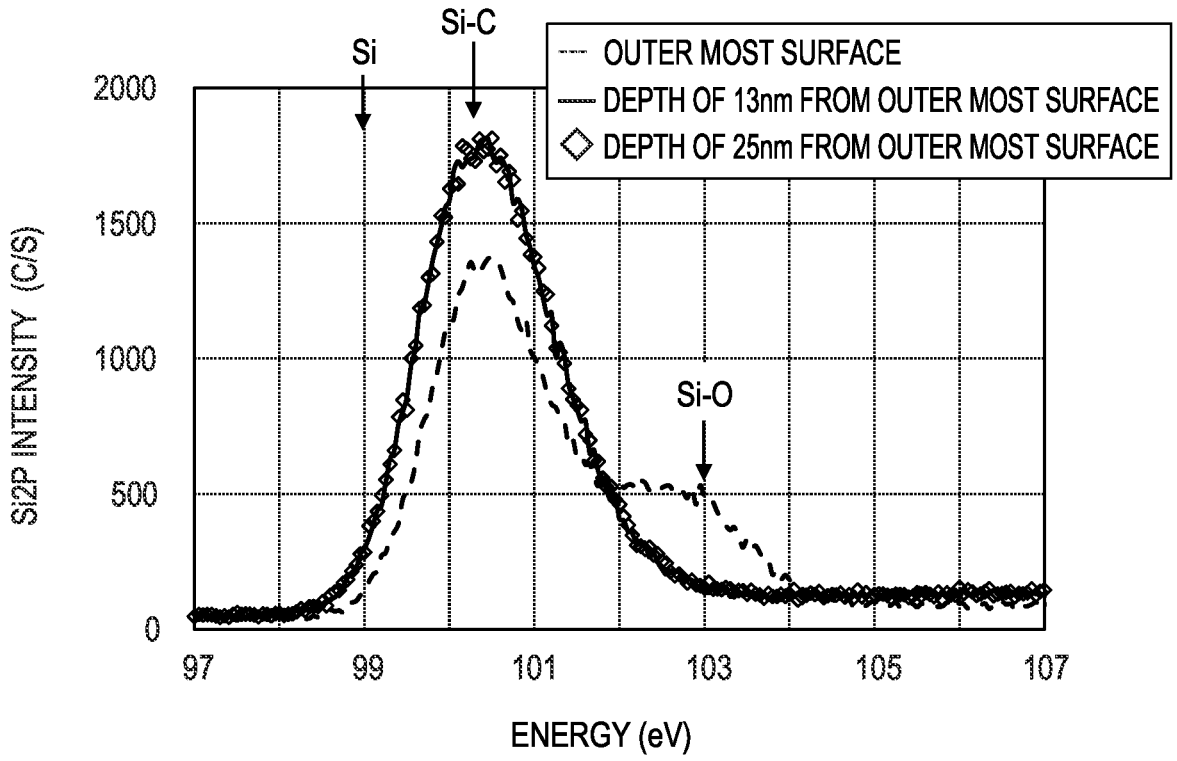
FIG. 9 is a graph for showing the bonding state of silicon atoms obtained as a result of the analysis of an intermediate layer formed in Comparative Example 1 by XPS.

A laminated structural body was produced in the same manner as in Example 1 except that an intermediate layer formed of silicon carbide having a film thickness of 60 nm was formed through use of a silicon carbide target as the target. Herein, the bonding state of the silicon atoms obtained by XPS of the intermediate layer according to this Comparative Example is shown in FIG. 9. The peak top of binding energy of a 2p orbital of the silicon atom was found at a position at which the peak top indicating the binding energy of silicon carbide appeared. When defining a number of silicon atom in the intermediate layer as (Si), a number of carbon atom in the intermediate layer as (C), and a total number of all elements excluding hydrogen atom in the intermediate layer as (A), a ratio of [(Si)+(C)]/A that was not able to be detected by XPS in the intermediate layer was 0.95. In addition, a ratio of (Si)/(C) in the intermediate layer 316 was 0.86.

Table 1 shows the adhesiveness and fastness property of each of the laminated structural bodies of Example 1 and Comparative Examples 1 to 3 evaluated by a scratch test conforming to Japanese Industrial Standards (JIS) R3255 (1997). The film was scanned with a stylus having a distal end radius of 5 μm while the stylus was pressed against the film, and the adhesiveness and fastness property of the laminated structural body were evaluated from a load value (critical load value) at a time when the film fracture occurred while the pressing load was increased.

In the laminated structural body according to Comparative Example 1, the surface layer including the DLC film peeled off after the laminated structural body was produced and before the scratch test was performed. In addition, the laminated structural body of Example 1 exhibited a critical load equal to or more than twice the critical load exhibited by each of the laminated structural bodies of Comparative Example 2 and Comparative Example 3 as a result of the scratch test.

The mechanism of action of the laminated structural body according to Example 1 for exhibiting such a high critical load is conceived as described below. The intermediate layer according to Example 1 contains silicon that has become excess in the bond of Si—C and a silicon simple substance, and hence the intermediate layer has particularly high adhesiveness to aluminum nitride and DLC. In addition, it is conceived that the intermediate layer has a high fastness property because the intermediate layer contains silicon carbide.

In addition, in each of the laminated structural bodies of Example 1 and Comparative Examples 1 to 3, aluminum nitride is used as a base material, but the outermost surface thereof is formed of an oxide of aluminum also including a natural oxide film. Therefore, it is conceived that, even when aluminum oxide is used as the base material, the same results as those of the laminated structural bodies of Example 1 and Comparative Examples 1 to 3 are obtained.

Figure 10:
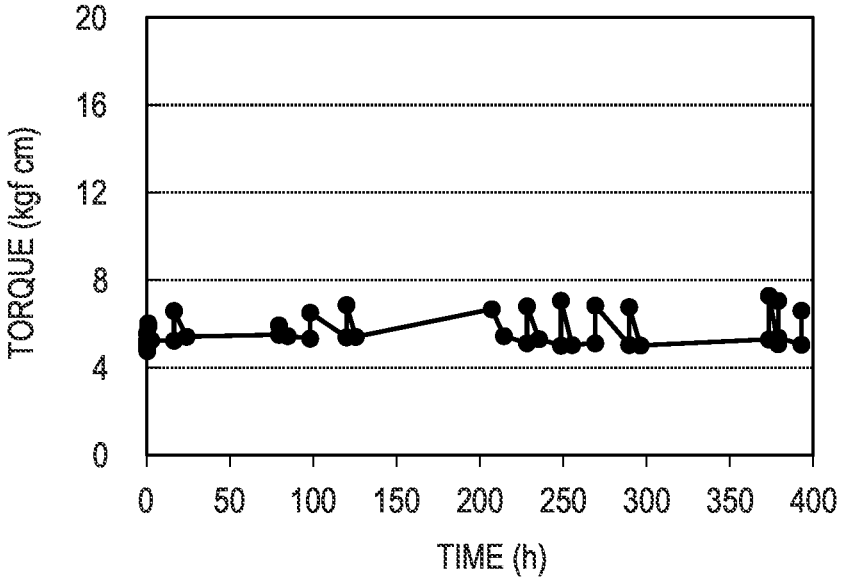
FIG. 10 is a graph for showing results of a durability test of the heat fixing device according to the present disclosure.

In addition, the durability test of the heat fixing device illustrated in FIG. 1 using the laminated structural body of Example 1 was performed. FIG. 10 shows the transition of torque for rotating the fixing belt with respect to time. As shown in FIG. 10, an increase in torque and abnormality were not found even after 350 hours of operation. In addition, generation of abnormal noise during the fixing operation and damage to the members of the heat fixing device, such as the fixing belt, were not found. The case in which generation of abnormal noise during the fixing operation and damage to the members of the heat fixing device, such as the fixing belt, were not found was defined as "durable".

In the same manner as in the laminated structural body according to Example 1, the laminated structural bodies according to Examples 2 to 5 were similarly each subjected to the durability test of the heat fixing device. As shown in Table 2, as a result, an increase in torque and damage to the members of the heat fixing device did not occur as in Example 1, and high durability was exhibited even after 350 hours of operation. Accordingly, the Examples 2 to 5 were evaluated as "Durable".

TABLE 1

| | | Example 1 | Comparative Example 1 | Comparative Example 2 | Comparative Example 3 |
|---|---|---|---|---|---|
| Material for heater base material | | AlN (Surface is AlO) | AlN (Surface is AlO) | AlN (Surface is AlO) | AlN (Surface is AlO) |
| Arithmetic average roughness (Ra) of surface of heater base material | | 0.13 μm | 0.13 μm | 0.13 μm | 0.13 μm |
| Sliding layer | | DLC (film thickness: 500 nm) | DLC (film thickness: 500 nm) | DLC (film thickness: 500 nm) | DLC (film thickness: 500 nm) |
| Intermediate layer | Material (film thickness) | Layer containing metal silicon and silicon carbide (film thickness: 60 nm) | Absent | Titanium metal layer (film thickness: 60 nm) | Silicon carbide layer (film thickness: 60 nm) |
| | [(Si) + (C)]/A | 0.95 | — | — | 0.95 |
| | (Si)/(C) | 2.02 | — | — | 0.86 |
| Presence or absence of peeling of DLC film from intermediate layer | | No peeling | Peeling occurred | No peeling | No peeling |
| Critical load in scratch test | | 175 mN | — | 78 mN | 73 mN |

TABLE 2

| | Example 1 | Example 2 | Example 3 | Example4 | Example 5 |
|---|---|---|---|---|---|
| Material for heater base material | AlN (Surface is AlO) | AlN (Surface is AlO) | AlN (Surface is AlO) | AlN (Surface is AlO) | AlN (Surface is AlO) |
| Arithmetic average roughness (Ra) of heater base material | 0.13 μm | 0.13 μm | 0.13 μm | 0.35 μm | 0.13 μm |
| (Si/C ratio) in intermediate layer | 2.02 | 2.55 | 2.55 | 2.02 | 1.55 |
| Thickness of intermediate layer | 60 nm | 20 nm | 20 nm | 60 nm | 60 nm |
| Thickness of DLC film | 500 nm | 500 nm | 650 nm | 500 nm | 500 nm |
| Durability test of fixing unit | Durable | Durable | Durable | Durable | Durable |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-075675, filed Apr. 21, 2020, which is hereby incorporated by reference herein in its entirety.

What is claimed:

1. A heat fixing device comprising:

a first member which is rotatable;

a heater configured to heat the first member; and a second member which is rotatable, and is configured to form a nip portion that allows a recording material to be sandwiched between the first member and the second member, wherein the heater includes:

a base material;

an intermediate layer on the base material; and a surface layer on the intermediate layer, the surface layer constituting a surface configured to slide on an inner peripheral surface of the first member, wherein the base material contains at least one compound selected from the group consisting of aluminum nitride, aluminum oxide, and silicon nitride, wherein the surface layer includes a diamond-like carbon film, wherein the intermediate layer contains silicon carbide, and wherein when (Si) is a number of silicon atoms in the intermediate layer, (C) is a number of carbon atoms in the intermediate layer, and (A) is a total number of atoms of all elements excluding hydrogen in the intermediate layer, a ratio of [(Si)+(C)]/A is 0.8 or more, and a ratio of (Si)/(C) is more than 1.

2. The heat fixing device according to claim 1, wherein the base material has an arithmetic average roughness Ra of from 0.13 μm to 0.35 μm on a surface on a side opposed to the intermediate layer.

3. The heat fixing device according to claim 1, wherein when (H) is a number of hydrogen atoms in the diamond-like carbon film, and (C') is a number of carbon atoms in the diamond-like carbon film, a ratio of (H)/[(H)+(C')] is 0.00 to 0.02.

4. The heat fixing device according to claim 1, wherein when the intermediate layer is analyzed by X-ray photoelectron spectroscopy through use of AlKα as a light source, a peak indicating a binding energy of a 2p orbital of a silicon atom has a peak top at more than 99.0 eV to less than 100.4 eV.

5. The heat fixing device according to claim 1, wherein the ratio of (Si)/(C) is 2.0 or more.

6. The heat fixing device according to claim 1, wherein the ratio of (Si)/(C) is 2.0 to 2.6.

7. The heat fixing device according to claim 1, wherein the first member includes a resin film constituting the inner peripheral surface of the first member, and the resin film contains a polyimide.

8. The heat fixing device according to claim 1, further including a lubricant which is interposed between the inner peripheral surface of the first member and the surface layer of the fixing device.

9. The heat fixing device according to claim 1, wherein the first member is a fixing belt having an endless shape, and the second member is a pressure roller.

10. The heat fixing device according to claim 1, wherein the first member is a fixing belt having an endless shape, and the second member is a pressure belt having an endless shape.

11. An electrophotographic image forming apparatus comprising a heat fixing device comprising:

a first member which is rotatable;

a heater configured to heat the first member; and a second member which is rotatable, and is configured to form a nip portion that allows a recording material to be sandwiched between the first member and the second member, wherein the heater includes:

a base material;

an intermediate layer on the base material; and a surface layer on the intermediate layer, the surface layer constituting a surface configured to slide on an inner peripheral surface of the first member, wherein the base material contains at least one compound selected from the group consisting of aluminum nitride, aluminum oxide, and silicon nitride, wherein the surface layer includes a diamond-like carbon film, wherein the intermediate layer contains silicon carbide, and wherein when (Si) is a number of silicon atoms in the intermediate layer, (C) is a number of carbon atoms in the intermediate layer, and (A) is a total number of atoms of all elements excluding hydrogen in the intermediate layer, a ratio of [(Si)+(C)]/A is 0.8 or more, and a ratio of (Si)/(C) is more than 1.

12. A laminated structural body comprising a base material, an intermediate layer, and a diamond-like carbon film in the stated order, wherein the base material contains at least one compound selected from the group consisting of aluminum nitride, aluminum oxide, and silicon nitride, wherein the intermediate layer contains silicon carbide, and wherein when (Si) is a number of silicon atoms in the intermediate layer, (C) is a number of carbon atoms in the intermediate layer, and (A) is a total number of atoms of all elements excluding hydrogen in the intermediate layer, a ratio of [(Si)+(C)]/A is 0.8 or more, and a ratio of (Si)/(C) is more than 1.

13. The laminated structural body according to claim 12, wherein when (H) is a number of hydrogen atoms in the diamond-like carbon film, and (C') is a number of carbon atoms in the diamond-like carbon film, a ratio of (H)/[(H)+(C')] is 0.00 to 0.02.

14. The laminated structural body according to claim 12, wherein when the intermediate layer is analyzed by X-ray photoelectron spectroscopy through use of AlKα as a light source, a peak indicating a binding energy of a 2p orbital of a silicon atom has a peak top at more than 99.0 eV to less than 100.4 eV.

15. The laminated structural body according to claim 12, wherein the ratio of (Si)/(C) is 2.0 or more.

16. The laminated structural body according to claim 12, wherein the ratio of (Si)/(C) is 2.0 or more and 2.6 or less.

* * * * *